US009372463B2

(12) United States Patent
Shimura

(10) Patent No.: US 9,372,463 B2
(45) Date of Patent: Jun. 21, 2016

(54) IMAGE FORMING APPARATUS INCLUDING FIXING SECTION HAVING HEAT GENERATING MEMBERS SWITCHABLE BETWEEN SERIES AND PARALLEL CONNECTION CONDITIONS

(75) Inventor: Yasuhiro Shimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 20 days.

(21) Appl. No.: 14/236,470

(22) PCT Filed: Sep. 13, 2012

(86) PCT No.: PCT/JP2012/074137

§ 371 (c)(1),
(2), (4) Date: Jan. 31, 2014

(87) PCT Pub. No.: WO2013/039264

PCT Pub. Date: Mar. 21, 2013

(65) Prior Publication Data

US 2014/0169811 A1 Jun. 19, 2014

(30) Foreign Application Priority Data

Sep. 15, 2011 (JP) ..... 2011-201835
Sep. 6, 2012 (JP) ..... 2012-196240

(51) Int. Cl.
*G03G 15/20* (2006.01)
*G03G 15/00* (2006.01)

(52) U.S. Cl.
CPC ..... *G03G 15/55* (2013.01); *G03G 15/2039* (2013.01); *G03G 15/5004* (2013.01)

(58) Field of Classification Search
CPC ..... G03G 15/55; G03G 15/2039
USPC ..... 399/33
See application file for complete search history.

(56) References Cited

U.S. PATENT DOCUMENTS 4,745,430 A * 5/1988 Tsuchiya ..... 399/33
5,229,577 A 7/1993 Matsuura et al.

(Continued)

FOREIGN PATENT DOCUMENTS

JP 07-199702 A 8/1995
JP 2000-259259 A 9/2000

(Continued)

OTHER PUBLICATIONS

International Search Report (PCT/ISA/210) dated Dec. 18, 2012, issued in PCT Application No. PCT/JP2012/074137, and Written Opinion of the International Searching Authority (PCT/ISA/237).

(Continued)

*Primary Examiner* — Billy Lactaoen
*Assistant Examiner* — Arlene Heredia Ocasio
(74) *Attorney, Agent, or Firm* — Fitzpatrick, Cella, Harper & Scinto

(57) ABSTRACT

An image forming apparatus, where, at suitable positions in a power supply path of a first heat generating member and a second heat generating member which can be switched to a series connection condition and a parallel connection condition, there are arranged a current detection section including a circuit which detects a current subjected to rectification of a positive half wave and a circuit which detects a current subjected to rectification of a negative half wave, and an applied voltage detection section including a circuit which detects a voltage subjected to full-wave rectification. Consequently, in the image forming apparatus which can be used in locations using different power supply voltages, failure of the apparatus can be detected, and reliability of the apparatus can be enhanced.

13 Claims, 10 Drawing Sheets

(56) References Cited

U.S. PATENT DOCUMENTS

| | | | | |
|---|---|---|---|---|
| 7,076,183 | B2 * | 7/2006 | Kawazu et al. | 399/69 |
| 7,247,816 | B2 * | 7/2007 | Kishi et al. | 219/216 |
| 7,630,662 | B2 | 12/2009 | Namiki et al. | |
| 8,494,383 | B2 | 7/2013 | Shimura et al. | |
| 8,606,136 | B2 | 12/2013 | Shimura et al. | |
| 8,642,927 | B2 | 2/2014 | Shimura | |
| 8,653,422 | B2 | 2/2014 | Shimura et al. | |
| 8,698,046 | B2 | 4/2014 | Shimura et al. | |
| 2006/0051111 | A1 * | 3/2006 | Kishi et al. | 399/33 |
| 2008/0267643 | A1 * | 10/2008 | Takami | 399/33 |
| 2009/0003868 | A1 * | 1/2009 | Namiki et al. | 399/69 |
| 2011/0280596 | A1 * | 11/2011 | Shimura | 399/33 |
| 2011/0305469 | A1 * | 12/2011 | Fujiwara et al. | 399/33 |
| 2012/0000897 | A1 | 1/2012 | Shimura | |
| 2012/0308252 | A1 | 12/2012 | Shimura | |

FOREIGN PATENT DOCUMENTS

| | | | |
|---|---|---|---|
| JP | 3919670 | B2 | 5/2007 |
| JP | 2007-212503 | A | 8/2007 |
| JP | 2008-003469 | A | 1/2008 |
| JP | 2011-112911 | A | 6/2011 |
| JP | 2011-215602 | A | 10/2011 |

OTHER PUBLICATIONS

Notification Concerning Transmittal of International Preliminary Report on Patentability (PCT/IB/326) dated Mar. 27, 2014, issued in counterpart PCT Application No. PCT/JP2012/0074137, International Preliminary Report on Patentability (PCT/IB/373) dated Mar. 18, 2014, and Written Opinion of the International Searching Authority (PCT/ISA/237) dated Dec. 18, 2012.

* cited by examiner

FIG. 6

| WAVEFORM OF HEATER CURRENT | | FIG. 5A | FIG. 5B | FIG. 5C |
|---|---|---|---|---|
| WAVEFORM 1 | POWER | 4000 W | 2000 W | 2000 W |
| | VOLTAGE DETECTION SECTION 400 | 200 Vrms | 200 Vrms | 200 Vrms |
| | | ○ | ○ | ○ |
| | CURRENT DETECTION SECTION 501 | 10 Arms | 10 Arms | 0 Arms |
| | | ○ | ○ | × |
| | CURRENT DETECTION SECTION 502 | 10 Arms | 10 Arms | 0 Arms |
| | | ○ | ○ | × |
| WAVEFORM 2 | POWER | 2640 W | 1320 W | 1320 W |
| | VOLTAGE DETECTION SECTION 400 | 162.5 Vrms | 162.5 Vrms | 162.5 Vrms |
| | | ○ | ○ | ○ |
| | CURRENT DETECTION SECTION 501 | 8.1 Arms | 8.1 Arms | 0 Arms |
| | | ○ | ○ | × |
| | CURRENT DETECTION SECTION 502 | 8.1 Arms | 8.1 Arms | 0 Arms |
| | | ○ | ○ | × |
| WAVEFORM 3 | POWER | 1320 W | 660 W | 660 W |
| | VOLTAGE DETECTION SECTION 400 | 114.9 Vrms | 114.9 Vrms | 114.9 Vrms |
| | | × | × | × |
| | CURRENT DETECTION SECTION 501 | 8.1 Arms | 8.1 Arms | 0 Arms |
| | | ○ | ○ | × |
| | CURRENT DETECTION SECTION 502 | 0 Arms | 0 Arms | 0 Arms |
| | | × | × | × |
| WAVEFORM 4 | POWER | 1320 W | 660 W | 660 W |
| | VOLTAGE DETECTION SECTION 400 | 114.9 Vrms | 114.9 Vrms | 114.9 Vrms |
| | | × | × | × |
| | CURRENT DETECTION SECTION 501 | 0 Arms | 0 Arms | 0 Arms |
| | | × | × | × |
| | CURRENT DETECTION SECTION 502 | 8.1 Arms | 8.1 Arms | 0 Arms |
| | | ○ | ○ | × |
| WAVEFORM 5 | POWER | 2640 W | 1320 W | 1320 W |
| | VOLTAGE DETECTION SECTION 400 | 162.5 Vrms | 162.5 Vrms | 162.5 Vrms |
| | | ○ | ○ | ○ |
| | CURRENT DETECTION SECTION 501 | 5.7 Arms | 5.7 Arms | 0 Arms |
| | | × | × | × |
| | CURRENT DETECTION SECTION 502 | 10 Arms | 10 Arms | 0 Arms |
| | | ○ | ○ | × |

IMAGE FORMING APPARATUS INCLUDING FIXING SECTION HAVING HEAT GENERATING MEMBERS SWITCHABLE BETWEEN SERIES AND PARALLEL CONNECTION CONDITIONS

TECHNICAL FIELD

The present invention relates to an image forming apparatus such as a photocopier or a laser beam printer, and more particularly, it relates to an image forming apparatus including a fixing section which heat-fixes an image formed on a recording material to the recording material.

BACKGROUND ART

When an image forming apparatus for a location where a voltage of a commercial power supply of a 100 V series (e.g., 100 V to 127 V) is used in a location supplying power for a 200 V series (e.g., 200 V to 240 V), the maximum power that can be supplied to a heater of a fixing section is quadrupled. When the maximum power that can be supplied to the heater becomes large, higher harmonic current, flicker or the like generated in heater power control, such as phase control or wave number control, becomes noticeable. Moreover, during the use in a location supplying 200 V, the power generated when the apparatus does not normally operate but thermally runs away increases four times as much as during its use in a location supplying 100 V, and hence a quick response safety circuit is required. Therefore, the heater is frequently replaced with a heater having a different resistance value for each location, so that the one image forming apparatus can be used in both a location where the commercial power supply voltage is 100 V and a location where the voltage is 200 V.

On the other hand, there is suggested a method of switching the resistance value of the heater by use of switch means, such as a relay, as means for realizing a universal image forming apparatus which can be used in both a location where the commercial power supply voltage of 100 V is supplied and a location where the commercial power supply voltage of 200 V is supplied. In Japanese Patent Application Laid-Open No. H07-199702 and U.S. Pat. No. 5,229,577, there is suggested an apparatus including first and second heat generating members, and it is possible to switch to a first operation condition where the first and second heat generating members are connected in series or a second operation condition where the members are connected in parallel, whereby the resistance value of each heat generating member is switched in accordance with a commercial power supply voltage, so that the commercial power supply voltage can be used in either of a location supplying 100 V and a location supplying 200 V.

In a method of switching the first and second heat generating members to a series connection condition and a parallel connection condition in accordance with the commercial power supply voltage, the resistance value of the heater can be switched without changing the heat generation area of the heater. In other words, the two heat generating members generate heat, when used in either of a location supplying 100 V and a location supplying 200 V. In a fixing apparatus including an endless belt, a heater which comes in contact with the inner surface of the endless belt, and a pressurizing roller which forms a fixing nip portion together with the heater via the endless belt, the above-mentioned series/parallel switching method is especially effective. This is because the two heat generating members generate the heat even when used in either of a location supplying 100 V and a location supplying 200 V, and hence a temperature distribution of the fixing nip portion in a recording material conveyance direction becomes the same irrespective of the location in which the apparatus is used. Therefore, there is the merit that the fixing properties of a toner image are not influenced by the location where the apparatus is used.

However, in the above method, when a detection section of the power supply voltage or a resistance value switch relay fails to operate properly, an excessively large power can be supplied to the heater sometimes. For example, while the image forming apparatus is connected to a commercial power supply of 200 V, the power which is four times as large as the power at a normal time that can be supplied to the heater in the parallel connection condition where the resistance value of the heater becomes low. Since the power supplied to the heater becomes excessively large, the response speed to interrupt the power supplied to the heater becomes insufficient sometimes in the safety circuit in which a temperature detection element such as a thermistor, a temperature fuse or a thermo SW is used. Therefore, in an image heating apparatus in which the resistance value can be switched, it is necessary to detect a failure condition where the large power is supplied to the heater by a method other than the method of detecting the temperature.

A purpose of the invention is to cope with various failure conditions of an apparatus in the apparatus in which first and second heat generating members can be switched to a series connection condition and a parallel connection condition.

SUMMARY OF INVENTION

Solution to Problem

To achieve the above object, according to the present invention, a purpose of the invention is to provide an image forming apparatus including a fixing section which heat-fixes an image formed on a recording material to the recording material. The fixing section includes a first heat generating member and a second heat generating member which generate heat by a power supplied from a power supply through a power supply path. The apparatus also includes a connection condition switch section which switches the first heat generating member and the second heat generating member to a series connection condition and a parallel connection condition. The further includes a first circuit disposed so that voltages applied to both ends of the first heat generating member and voltages applied to both ends of the second heat generating member are detectable, to detect the voltages of a positive phase and a negative phase of an alternating current waveform. Also, the apparatus includes a second circuit that detects a current of the positive phase of the alternating current waveform, the second circuit being disposed in the power supply path on the second heat generating member side after branching toward the first heat generating member and the second heat generating member in the parallel connection condition, or at a position in which the voltages applied to both the ends of the first heat generating member and the voltages applied to both the ends of the second heat generating member are detectable, to detect the voltage of the positive phase of the alternating current waveform. In addition, the apparatus includes a third circuit that detects a current of the negative phase of the alternating current waveform, the third circuit being disposed in the power supply path on the second heat generating member side after branching toward the first heat generating member and the second heat generating member in the parallel connection condition, or at a position in which the voltages applied to both the ends of the first heat generating member and the voltages applied to both the ends of the second heat generating member are detectable, to detect the voltage of the negative phase of the alternating current waveform.

Advantageous Effects of Invention

According to the present invention, it is possible to cope with various failure conditions of the apparatus in the apparatus in which the first and second heat generating members can be switched to the series connection condition and the parallel connection condition.

Further features of the present invention will become apparent from the following description of exemplary embodiments with reference to the attached drawings.

BRIEF DESCRIPTION OF DRAWINGS

FIG. 6 is a diagram illustrating a relation between a current waveform and a power flowing through a heater in the failure condition, and a case where abnormality can be detected by the current detection section and a case where the abnormality can be detected by the voltage detection section.

DESCRIPTION OF EMBODIMENTS

Hereinafter, the best mode for carrying out the present invention will be described in detail with reference to the accompanying drawings.

Embodiment 1

Figure 8:
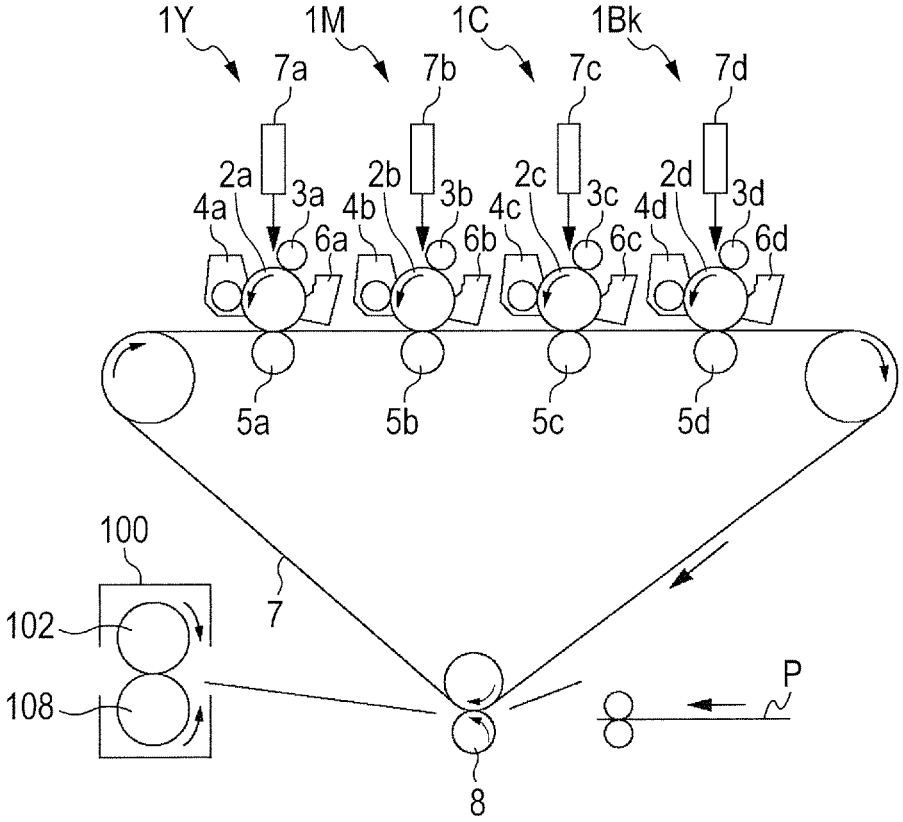
FIG. 8 is a schematic view of an image forming apparatus.

FIG. 8 is a sectional view of an image forming apparatus (a full color printer in the present example) using an electrophotographic recording technology. An image forming section which forms a toner image on a recording material P includes four image forming stations (1Y, 1M, 1C and 1Bk). Each image forming station includes a photosensitive member (2*a*, 2*b*, 2*c*, or 2*d*), a charging member (3*a*, 3*b*, 3*c*, or 3*d*), a laser scanner (7*a*, 7*b*, 7*c*, or 7*d*), a developer (4*a*, 4*b*, 4*c*, or 4*d*), a transfer member (5*a*, 5*b*, 5*c*, or 5*d*), and a cleaner (6*a*, 6*b*, 6*c*, or 6*d*) which cleans the photosensitive member. Furthermore, the image forming section includes a belt 7 which carries and conveys the toner image, and a secondary transfer roller 8 which transfers the toner image from the belt 7 to the recording material P. The operation of the above image forming section is well known, and hence a description thereof is omitted. The recording material P to which the unfixed toner image is transferred by the image forming section is conveyed to a fixing section 100, and the toner image is heat-fixed to the recording material P.

Figure 1:
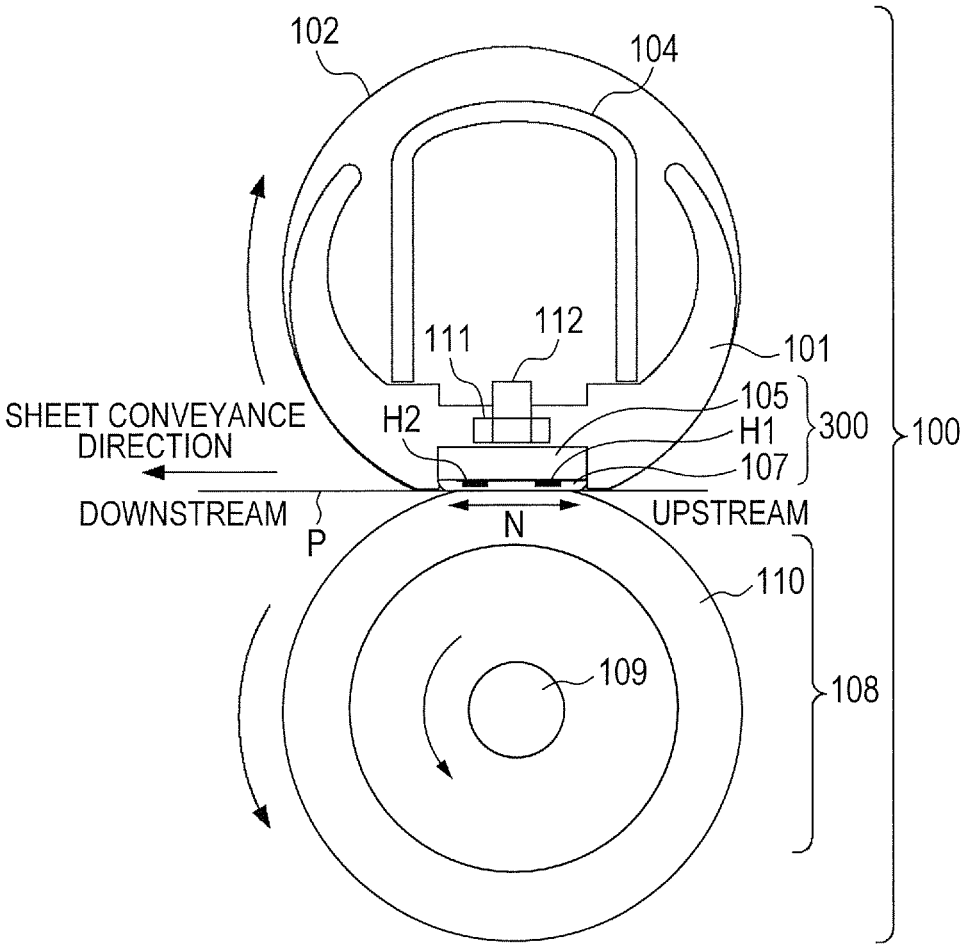
FIG. 1 is a sectional view of a fixing section.

FIG. 1 is a sectional view of the fixing section 100 which heat-fixes the image on the recording material to the recording material. The fixing section 100 includes a tubular film (the endless belt) 102, a heater 300 which comes in contact with the inner surface of the film 102, and a pressurizing roller (a nip portion forming member) 108 which forms a fixing nip portion N together with the heater 300 via the film 102. The material of a base layer of the film is a heat resistant resin such as polyimide, or a metal such as stainless steel. The pressurizing roller 108 includes a metal core 109 composed of a material such as iron or aluminum, and an elastic layer 110 composed of a material such as silicone rubber. The heater 300 is held by a holding member 101 made of a heat resistant resin. The holding member 101 also has a guide function of guiding rotation of the film 102. The pressurizing roller 108 receives power from an unshown motor to rotate in an arrow direction. When the pressurizing roller 108 rotates, the film 102 follows and rotates.

The heater 300 includes a heater substrate 105 made of a ceramic, a first heat generating member H1 and a second heat generating member H2 formed on the heater substrate by use of a heat generation resistor, and a surface protective layer 107 composed of an insulating material (glass in the present embodiment) which coats the heat generating members H1 and H2. A temperature detection element 111, such as a thermistor, abuts on a paper passing region of a usable minimum size paper (an envelope DL: 110 mm wide in the present example) set to a printer on the back surface side of the heater substrate 105. In accordance with a detected temperature of the temperature detection element 111, power to be supplied from a commercial alternating current power supply to the heater is controlled. The recording material (the sheet) P carrying the unfixed toner image is heat-fixed while the material is held and conveyed by the fixing nip portion N. A safety element 112, such as a thermo switch, which operates at an abnormal temperature rise of the heater to interrupt a power supply line (the power supply path) to the heater, also abuts on the back surface side of the heater substrate 105. The safety element 112 abuts on the paper passing region of the minimum size paper similarly to the temperature detection element 111. Reference numeral 104 denotes a stay made of a metal to apply a pressure of an unshown spring to the holding member 101.

Figure 2:
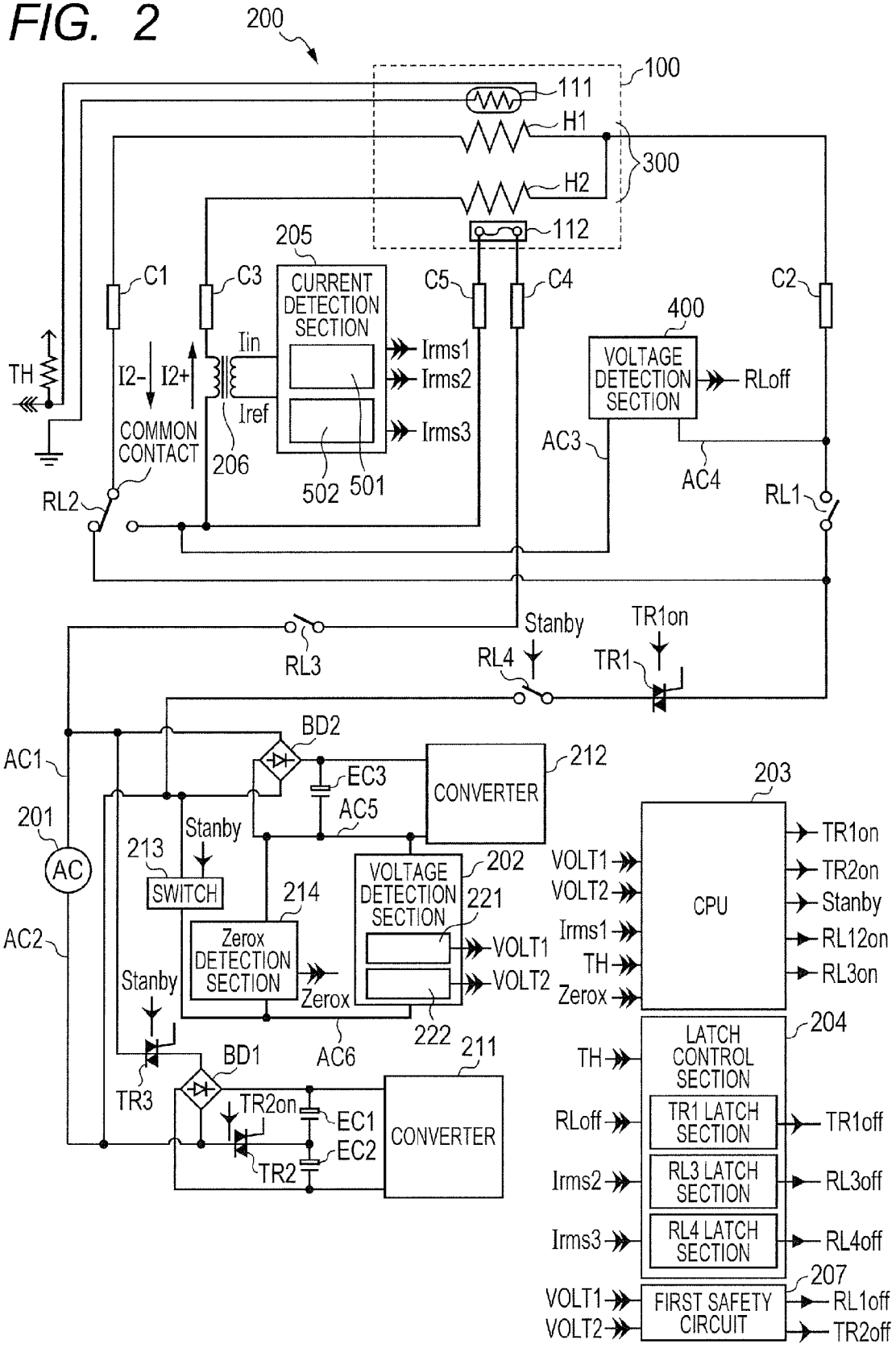
FIG. 2 is a power supply circuit diagram in a state where the fixing section is connected.

FIG. 2 shows a power supply circuit 200 to which the fixing section 100 is connected, a CPU 203, a latch control section (the second safety circuit) 204, and a first safety circuit 207. C1, C2, C3, C4 and C5 are connectors which connect the power supply circuit 200 to the heater 300. Reference numeral 201 denotes a commercial alternating current power supply, and power control to the heater 300 is performed by energization/interruption of a triac TR1 (the semiconductor drive element). The triac TR1 operates in accordance with a heater drive signal TR1*on* from the CPU 203. The temperature detected by the temperature detection element 111 is detected as a partial pressure of a pull-up resistor, and input as a TH signal into the CPU 203. In internal processing of the CPU 203, power to be supplied is calculated based on the detected temperature of the temperature detection element 111 and a set temperature of the heater 300 by, for example, PI control, and the power is converted to a control level of a phase angle (the phase control) or a wave number (the wave number control), to control the triac TR1.

As described later, the heater 300 includes the first heat generating member H1 and the second heat generating member H2, and has a constitution where the first heat generating member H1 and the second heat generating member H2 can be switched to a series connection condition or a parallel connection condition in accordance with the output of a voltage detection unit (the power supply voltage detection unit) 202 which detects the power supply voltage.

The power supply circuit 200, separately from the power supply circuit to the heater 300, includes an AC/DC converter which generates power to be supplied to the motor, the CPU or the like from the alternating current power supply 201.

Next, an outline of the AC/DC converter of the power supply circuit 200 will be described. The AC/DC converter of the present embodiment is constituted of a converter 211 and a converter 212. The converter 211 supplies power to drive the unshown motor or the like of the image forming apparatus, and the converter 212 supplies power to a control executing part such as the CPU 203, the latch control section 204 or the voltage detection unit 202.

First, the converter 211 will be described. A bridge diode BD1 is a circuit to perform full-wave rectification and voltage doubler rectification of the alternating current power supply 201. EC1 and EC2 are electrolytic capacitors for smoothing. One end of a triac TR2 is connected to a midpoint between the capacitor EC1 and the capacitor EC2, and the other end of the triac TR2 is connected to the alternating current power supply 201. In a full-wave rectification condition, the triac TR2 is turned off, and the voltage rectified by the bridge diode BD1 is applied to a synthetic capacity connected to the capacitors EC1 and EC2 in series. In a voltage doubler rectification condition, the triac TR2 is turned on, the capacitor EC1 is charged with a positive phase half wave, the capacitor EC2 is charged with a negative phase half wave, and each peak is held. Therefore, the voltage, which is substantially twice as high as in the full-wave rectification condition, is applied to the converter 211.

Next, the converter 212 will be described. The converter 212 is an operable converter in a full range even when a range of the power supply voltage is either of 100 V series and 200 V series. A bridge diode BD2 is used to rectify the alternating current power supply 201. EC3 is an electrolytic capacitor for smoothing. The converter 212 is used in a power supply for a small load, such as the CPU or a sensor, and hence there can be designed the converter which can comparatively simply operate in a full range, even when the switching to the voltage doubler rectification or the full-wave rectification is not performed. In contrast, the converter 211 drives a large load element, such as the motor, and hence it is necessary to output large power. In a converter which can output the large power and especially does not include power factor correction (PFC) circuit, it is difficult to be operable in the full range without performing the switching to the voltage doubler rectification or the full-wave rectification sometimes. Therefore, in the converter 211 of the present embodiment, the switching to the voltage doubler rectification or the full-wave rectification is performed in accordance with the voltage of the alternating current power supply 201. Specifically, when the voltage of the alternating current power supply 201 is 100 V, the voltage doubler rectification is performed, and when the voltage of the alternating current power supply 201 is 200 V, the full-wave rectification is performed.

In the power supply circuit 200, when the image forming apparatus shifts from a power supply off state to a standby state, a standby signal becomes high, and the power is supplied to a switch 213, a relay RL4 and a triac TR3, so that the apparatus is turned on.

The switch 213 is a high pressure resistance switch to decrease the power consumed in a zero cross detection section 214 and the power supply voltage detection unit 202. When the switch 213 is turned on, the power supply voltage detection unit 202 and the zero cross detection section 214 become a detectable state. The zero cross detection section 214 detects a zero cross of the alternating current power supply 201, which is required when performing phase control of the triac TR1.

The voltage cannot be detected by the power supply voltage detection unit 202 until the apparatus shifts to the standby state (the standby signal is in a low state). However, the power supply to the relay RL4 and the triac TR3 is also interrupted, and hence the apparatus can be held in a safe state.

Next, there will be described the power supply voltage detection unit 202 which detects the voltage of the alternating current power supply 201, and a connection condition switch section (relays RL1 and RL2) which operates in accordance with the detected voltage of the power supply voltage detection unit 202

RL1, RL2, RL3 and RL4 shown in FIG. 2 are relays. FIG. 2 shows the connection conditions of the relays in the power supply off state of the image forming apparatus. The relays RL1 and RL2 function as a connection condition switch section which switches the first heat generating member H1 and the second heat generating member H2 to the series connection condition or the parallel connection condition. Additionally, RL1 includes a make contact or a break contact. Moreover, RL2 includes a transfer contact. The relays RL3 and RL4 have a function of interrupting the power supply from the alternating current power supply 201 to the heater 300 (the switch section which interrupts the power supply to the heat generating members).

The power supply voltage detection unit 202 is a circuit to detect the voltage of the alternating current power supply 201. The power supply voltage detection unit 202 is constituted of a voltage detection section 221 and a voltage detection section 222. Next, there will be described a voltage detection method using a VOLT1 signal of the voltage detection section 221 and a VOLT2 signal of the voltage detection section 222.

The power supply voltage detection unit 202 can cope with a case where an alternating current voltage of the alternating current power supply 201 has a waveform other than a sine wave. Therefore, the power supply voltage detection unit 202 is provided with the voltage detection section 221 to detect an alternating current voltage waveform having a high crest factor (a ratio between a maximum value and an effective value of the alternating current wave), and the voltage detection section 222 to detect an alternating current voltage waveform having a low crest factor.

The voltage applied to the capacitors EC1 and EC2 of the converter 211 has a peak hold waveform obtained by rectifying the AC power supply voltage. Therefore, the full-wave rectification condition and the voltage doubler rectification condition of the capacitors EC1 and EC2 are switched in accordance with an output signal VOLT1 of the voltage detection section 221 for use in detecting the alternating current voltage waveform having the high crest factor.

The power supplied to the heater 300, which is a resistance load, is proportional to the effective value of the input voltage. Therefore, to cope with both the waveform having the high crest factor (e.g., a triangular wave having a high peak voltage) and the waveform having the low crest factor (e.g., a square wave having a low peak voltage), the connection condition switch section (the relays RL1 and RL2) is controlled in accordance with both the output signal VOLT1 of the voltage detection section 221 and an output signal VOLT2 of the voltage detection section 222.

Figure 3A:
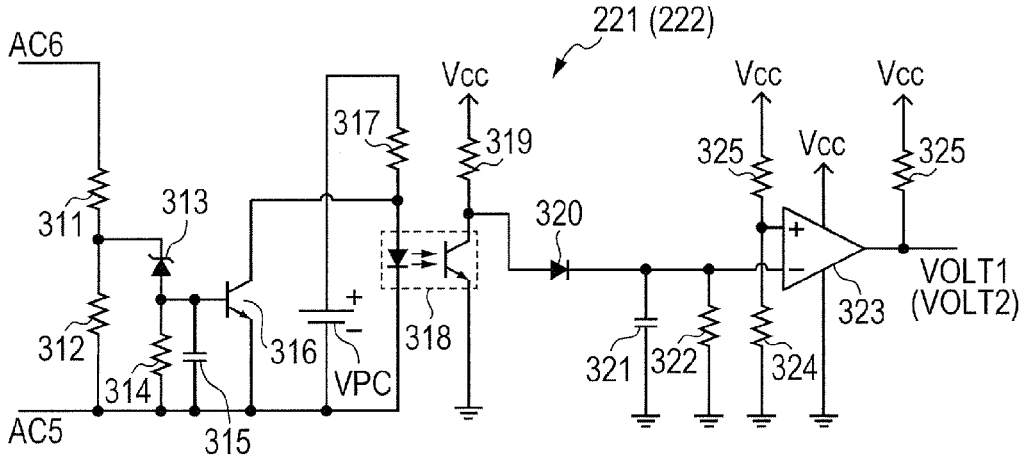
FIG. 3A shows a power supply voltage detection unit 202.

FIG. 3A is a circuit diagram of the voltage detection sections 221 and 222 constituting the power supply voltage detection unit 202. In the present embodiment, the voltage detection section 221 is different from the voltage detection section 222 only in a threshold voltage value and a threshold ratio described later.

There will be described a circuit operation to distinguish between 100 V series and 200 V series of the voltage applied between AC6 and AC5. As shown in FIG. 2, the AC5 is connected to AC1 via the bridge diode BD2 (FIG. 2). Therefore, when the voltage of the AC6 is larger than that of the AC5, as to the voltage of the AC5, it is possible to obtain a result substantially similar to that of a case where a voltage between AC2 and the AC1 is detected while the switch 213 is turned on. Additionally, the BD2 also functions as a diode for preventing a counterflow of a current. When the voltage applied between the AC6 and the AC5 is not smaller than a threshold voltage value, the voltage divided by resistors 311 and 312 has a value higher than a zener voltage of a zener diode 313. Moreover, when the voltage is applied to a resistor 314, a transistor 316 is turned on, and a primary light emitting diode of a photocoupler 318 enters a short state. A capacitor 315 is used as a noise countermeasure. A power supply VPC is a DC power supplied by an unshown transformer auxiliary winding voltage of the converter 212. A current is passed through the primary light emitting diode of the photocoupler 318 from the power supply VPC via a resistor 317. When the transistor 316 is turned off, the primary light emitting diode of the photocoupler 318 is in a light emitting state.

When the voltage applied between the AC6 and the AC5 becomes high, as described above, the transistor 316 is turned on, and the light emitting diode of the photocoupler 318 enters a non-emitting state. When the light emitting diode of the photocoupler 318 enters the non-emitting state, a secondary transistor is turned off, and a charging current flows through a capacitor 321 from Vcc via a resistor 319. Reference numeral 320 denotes a diode for preventing the counterflow of the current, and reference numeral 322 denotes a discharging resistor. When the voltage applied between the AC6 and the AC5 is high and a ratio of time to turn off the primary light emitting diode of the photocoupler 318 becomes large, the time when the charging current flows through the capacitor 321 increases, and hence the voltage of the capacitor 321 has a high value. When the voltage of the capacitor 321 is higher than a comparison voltage of a comparator 323 which is divided by resistors 325 and 324, the current flows through an output section of the comparator 323 from Vcc via the resistor 325, and the voltage of the output VOLT1 (VOLT2) becomes low. That is, when the power supply voltage is the 200 V series, the voltage of the VOLT1 (VOLT2) becomes low.

Next, the voltage detection section 221 and the voltage detection section 222 will be compared. As described above, in a case where the voltage applied between the AC6 and the AC5 is not lower than the threshold voltage value determined by the resistors 311 and 312 and the zener diode 313 for a longer time, the ratio (on-duty) of the time when the transistor 316 is turned on becomes large. In a case where the ratio of time when the voltage applied between the AC6 and the AC5 is in excess of the threshold voltage value is not smaller than a predetermined threshold ratio, the voltage of the output VOLT1 (VOLT2) becomes low. In the voltage detection section 221, to detect the alternating current voltage waveform having the high crest factor, the above-mentioned threshold voltage value is set to be high, and the threshold ratio is set to be low. In the voltage detection section 222, to detect the alternating current voltage waveform having the low crest factor, the threshold voltage value is set to be lower, and the threshold ratio is set to be higher than in the voltage detection section 221.

Next, a control method of the connection condition switch section (the relays RL1 and RL2) will be described. When both the voltage detection section 221 and the voltage detection section 222 detect 100 V, the first heat generating member H1 and the second heat generating member H2 are switched to the parallel connection condition. In accordance with a voltage detection result (100 V is detected) of the power supply voltage detection unit 202, the CPU 203 sets an RL12*on* signal to the high state, and turns on the RL1 and RL2 (the on state of RL2 is a state where an upper contact is a common contact and is connected to a right contact in FIG. 2). Furthermore, the CPU 203 sets an RL3*on* signal to the high state, and turns on RL3. As a consequence, the power can be supplied to the heater 300, and in this state, the first heat generating member H1 and the second heat generating member H2 are connected in parallel, and hence the resistance value of the heater 300 becomes low.

When at least one of the voltage detection section 221 and the voltage detection section 222 detects 200 V, the first heat generating member H1 and the second heat generating member H2 are switched to the series connection condition. In accordance with a voltage detection result (200 V is detected) of the voltage detection unit 202, the CPU 203 sets the RL12*on* signal to the low state, and holds the RL1 and RL2 in the off state as they are (the state of FIG. 2). Furthermore, the CPU 203 sets the RL3*on* signal to the high state, and turns on the RL3. As a consequence, the power can be supplied to the heater 300, and in this state, the first heat generating member H1 and the second heat generating member H2 are connected in series, and hence the resistance value of the heater 300 becomes high.

Next, a control method of the converter 211 will be described. When the voltage detection section 221 detects 100 V, the converter 211 is set to the voltage doubler rectification condition. In accordance with the voltage detection result (100 V is detected) of the voltage detection section 221, the CPU 203 sets a TR2*on* signal to the high state, and turns on the triac TR2. When the voltage detection section 221 detects 200 V, the converter 211 is set to the full-wave rectification condition. In accordance with the voltage detection result (200 V is detected) of the voltage detection section 221, the CPU 203 turns off a TR2*on* signal, and sets the triac TR2 to a non-conductive state.

Next, the first safety circuit 207 will be described. The first safety circuit 207 is a safety circuit (the hard circuit) which is independent of the CPU 203. As an operation of the first safety circuit 207, the circuit holds the relay RL1 in the off state, while it is detected that at least one of the VOLT1 signal and the VOLT2 signal is in the low state (i.e., while the voltage of 200 V series is detected). For example, even when the RL12*on* output from the CPU 203 becomes high, the RL1 can be held in the off state.

A reason why the only relay RL1 is turned off while at least one of the voltage detection sections 221 and 222 detects the 200 V state is that when the only the relay RL1 is turned off, it is possible to prevent a state where a large power is supplied to the heater 300, irrespective of the state of the relay RL2.

For example, there will be described a case where the voltage of the alternating current power supply 201 rises to 200 V owing to an abnormality of the commercial power supply or the like, when both the voltage detection sections 221 and 222 detect 100 V, and print processing (the fixing processing) is performed in the state where the first heat generating member H1 and the second heat generating member H2 are in the parallel connection condition. In this state, when the only relay RL1 is turned off, it is possible to interrupt all paths through which the current to the heater 300 flows. On the other hand, when both the relays RL1 and RL2 are turned off, the first heat generating member H1 and the second heat generating member H2 are switched to the series connection condition, and hence the power can be supplied to the heater 300.

Thus, in the abnormal condition where the alternating current power supply 201 rises from 100 V to 200 V, when the only relay RL1 is turned off, the safety of the apparatus can further be enhanced. Moreover, in the case where the alternating current power supply 201 rises from 100 V to 200 V during the print processing, power cannot be supplied to the heater 300, when the relay RL1 is turned off. A state where the temperature of the heater 300 abnormally decreases can be detected based on the TH signal. Thus, the abnormal condition can be detected by the thermistor 111, and the apparatus can safely be stopped.

Moreover, the first safety circuit 207 holds the converter 211 in the full-wave rectification condition, while the VOLT1 signal is in the low state. For example, even when the TR2*on* signal output from the CPU 203 becomes high, the triac TR2 can be held in the off state as it is.

Next, the latch control section (the second safety circuit) 204 will be described. The latch control section 204 is the safety circuit (the hard circuit) which is independent of the CPU 203. In one of a state where the temperature TH detected by the thermistor is not lower than a threshold temperature: a state where RLoff signal of a voltage detection section 400 (the applied voltage detection section, and also referred to as the first circuit) described later becomes low; a state where a detected current of Irms2 of a current detection section (also referred to as the second circuit) 501 described later is in excess of a predetermined threshold value; and a state where an Irms3 signal of a current detection section (also referred to as the third circuit) 502 described later becomes low, and TR1, RL3 and RL4 latch sections are activated, to interrupt the power to be supplied to the heater 300.

When the TR1, RL3 and RL4 latch sections are activated, the TR1*off* signal, the RL3*off* signal and the RL4*off* signal are held in the high state (latched). In this latching status, the triac TR1 and the relays RL3 and RL4 can be held in the off state without being influenced by the output of the CPU 203.

Next, a current detection section 205 will be described. The current detection section 205 detects the current flowing through the primary side via a current transformer 206. As shown in FIG. 2, the current detection section 205 is disposed in the power supply path after branching toward the first heat generating member H1 and the second heat generating member H2 in the parallel connection condition of the first heat generating member H1 and the second heat generating member H2 (the connection condition when the power supply voltage is 100 V). The current detection section 205 is constituted of the current detection circuit (the second circuit) 501 which detects the current (I2+) rectified with the half wave of the positive phase of an alternating current I2, and the current detection circuit (the third circuit) 502 which detects the current (I2−) rectified with the half wave of the negative phase.

First, the current detection circuit (the second circuit) 501 will be described. The current detection circuit 501 outputs a square value Irms1 of a current effective value for each cycle of a commercial power supply frequency and moving average deviations Irms2 of Irms1. The CPU 203 detects the current effective value for each cycle of the commercial power supply frequency, by Irms1. As an example of the current detection circuit 501, a current suggested in Japanese Patent Application Laid-Open No. 2007-212503 can be used. On the other hand, the moving average deviations Irms2 are output to the latch control section 204. When an overcurrent flows through the current transformer 206 and Irms2 is in excess of a predetermined threshold current value (the predetermined current), the latch control section 204 activates the TR1, RL3 and RL4 latch sections, holds the TR1, RL3 and RL4 in the off state, and interrupts the power supply to the fixing section 100 (correctly the heater 300). In the present embodiment, the triac TR1 and the relays RL3 and RL4 have a function of a switch section which interrupts the power supply to the heat generating members H1 and H2.

Thus, the current detection circuit 501 is disposed to detect a state where an excessive current flows through the power supply path to the heater 300. As the case where such an excessive current flows, there is a case where the relays RL1 and RL2 as the connection condition switch section fails to operate properly and the connection condition of the first heat generating member H1 and the second heat generating member H2 does not match the power supply voltage. This will be described later in detail.

The current detection circuit (the third circuit) 502 is also disposed to detect the state where the excessive current flows through the power supply path to the heater 300. The current detection circuit 502 detects the half wave (I2−) of the negative phase, and when the current of the negative phase in excess of the predetermined threshold current flows through the current transformer 206, the Irms3 signal of the current detection circuit 502 becomes low. When the Irms3 becomes low, the latch control section 204 activates the TR1, RL3 and RL4 latch sections, holds the TR1, RL3 and RL4 in the off state, and interrupts the power supply to the fixing section 100 (correctly the heater 300).

Figure 3B:
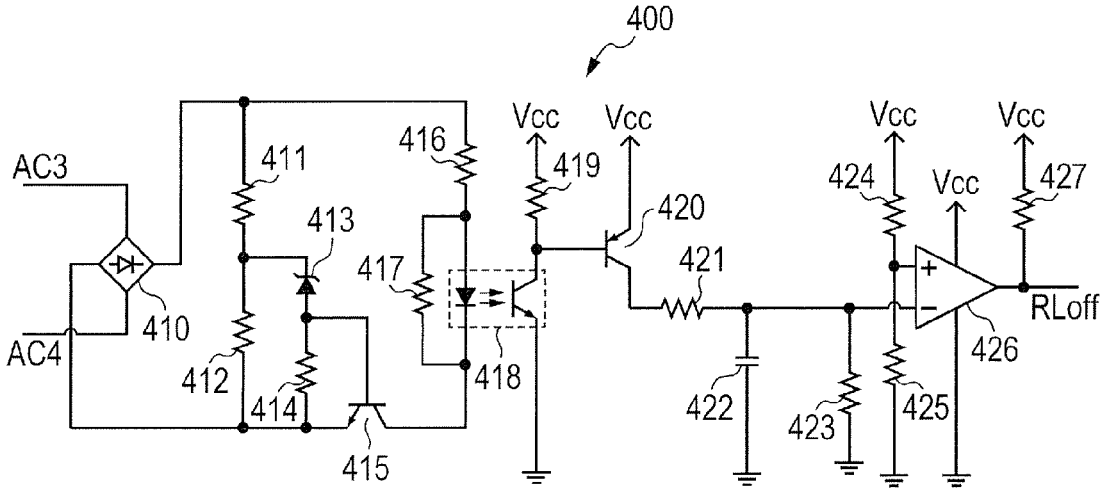
FIG. 3B shows an applied voltage detection section 400.
Figure 3C:
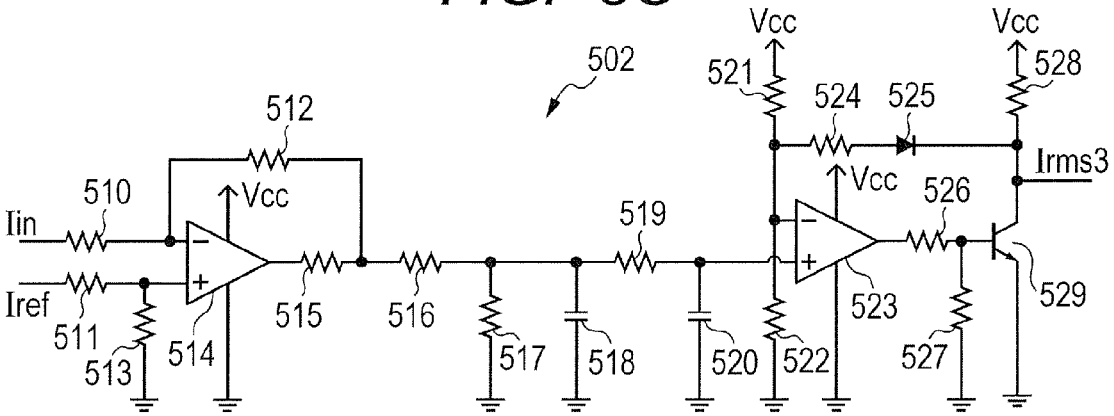
FIG. 3C is a circuit constitutional view of a current detection section 502.

FIG. 3C is a circuit diagram of the current detection circuit 502 which detects the half wave (I2−) of the negative phase. When the current value of the negative half wave flowing through the heat generating member H2 becomes large, the voltage (the output voltage) of an output Iin of the current transformer 206 has a voltage value smaller than an output Iref which is a reference voltage. In this current detection circuit, an operational amplifier 514 is used as a differential amplification circuit, and an amplification factor of the differential amplification circuit can be determined by a ratio between resistors 511/513 and resistors 510/512. A resistor 515 is a protection resistor of the operational amplifier 514. A waveform reversed and amplified by the operational amplifier 514 is smoothed by a filter circuit of a subsequent stage. A capacitor 518 is charged with the reversed and amplified waveform via a resistor 516. A resistor 517 is a discharge resistor. The voltage waveform of the capacitor 518 is smoothed by a resistor 519 and a capacitor 520, and input into an operational amplifier 523. When the voltage of the output Iin of the current transformer 206 becomes smaller than that of the output Iref, the current with which the capacitor 520 is charged becomes large. When the voltage of the capacitor 520 becomes larger than the comparison voltage of the operational amplifier 523, which is determined by a partial pressure resistance of resistors 521 and 522, the output of the operational amplifier 523 outputs Vcc. A transistor 529 is turned on via resistors 526 and 527, the current flows from Vcc via a resistor 528, and an output Irms3 signal becomes low. That is, when the current value of the negative half wave flowing through the heat generating member H2 becomes large, the output Irms3 signal becomes low. A resistor 524 and a diode 525 are used to impart hysteresis characteristics to the current detection section 502. The current detection section 502 outputs the Irms3 signal to the latch control section 204.

Next, the voltage detection section (the applied voltage detection section, and also referred to as the first circuit) 400 will be described. The voltage detection section 400 can be used in the failure detection of the apparatus similarly to the current detection section 205. The voltage detection section 400 is disposed to detect the voltages applied to both ends of the second heat generating member in the series connection condition of the first heat generating member H1 and the second heat generating member H2. The voltage detection section 400 distinguishes between a 100 V series and a 200 V series of the voltage applied to the heat generating member H2. Moreover, when the voltage is the 200 V series, the RLoff signal output to the latch control section 204 is set to the low state, the TR1, RL3 and RL4 latch sections are activated, the TR1, RL3 and RL4 are held in the off state, and the power supply to the heater 300 is interrupted.

Furthermore, the voltage detection section 400 can detect the voltages applied to both ends of the first heat generating member and the voltages applied to both ends of the second heat generating member in the parallel connection condition of the first heat generating member H1 and the second heat generating member H2. Therefore, for example, even in a state where the connector C3 drops out and the power is supplied only to the first heat generating member H1, the voltage of the heat generating member H1 can be detected. Moreover, the occurrence of a disconnection failure of the current transformer 206 is taken into consideration, and a contact AC3 is disposed at a position directly connected to a terminal of the RL2. For example, when the contact AC3 of the voltage detection section is disposed between the current transformer 206 and the connector C3, the current detection section 205 and the voltage detection section 400 do not simultaneously operate in the case of the disconnection failure of the current transformer 206. To avoid such a situation, the contact AC3 is disposed at a position directly connected to the terminal of the RL2.

FIG. 3B is a circuit diagram of the voltage detection section 400. The alternating current voltage between the AC3 and AC4 is subjected to full-wave rectification by a diode bridge 410. When the voltage applied between the AC3 and the AC4 is not lower than the threshold voltage value, the voltage divided by resistors 411 and 412 has a value higher than the zener voltage of a zener diode 413. Moreover, when the voltage is applied to a resistor 414, a transistor 415 is turned on, and the current flows through a primary light emitting diode of a photocoupler 418 via a resistor 416. Reference numeral 417 denotes a protection resistor of the photocoupler 418. When the current flows through the primary light emitting diode of the photocoupler 418, a secondary transistor operates, the current flows from Vcc via a resistor 419, a gate voltage of a transistor 420 becomes low, and the PNP transistor 420 turns on. When the transistor 420 is turned on, the charging current flows through a capacitor 422 from Vcc via a resistor 421. The current is discharged from the capacitor 422 via a discharge resistor 423. When the voltage of the capacitor 422 becomes larger than the comparison voltage of a comparator 426 which is divided by resistors 424 and 425, the current flows through an output section of the comparator 426 from Vcc via a resistor 427, and the voltage of the output RLoff becomes low. That is, when the voltages applied to both ends of the heat generating member H2 is not lower than the threshold voltage value, the voltage of the output RLoff of the voltage detection section 400 becomes low.

Figure 4A:
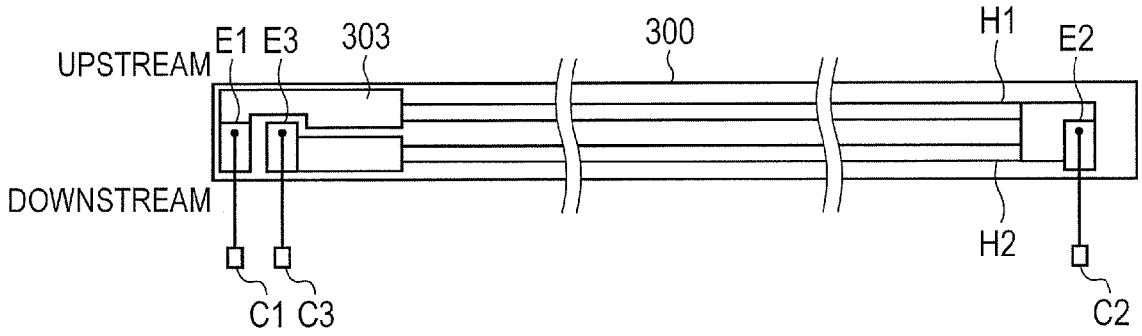
FIG. 4A is a view showing a heater constitution.
Figure 4B:
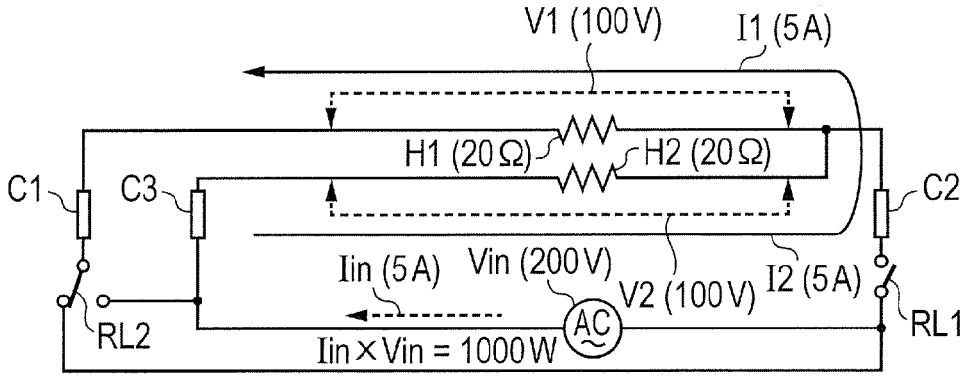
FIG. 4B is a view illustrating a series connection condition.
Figure 4C:
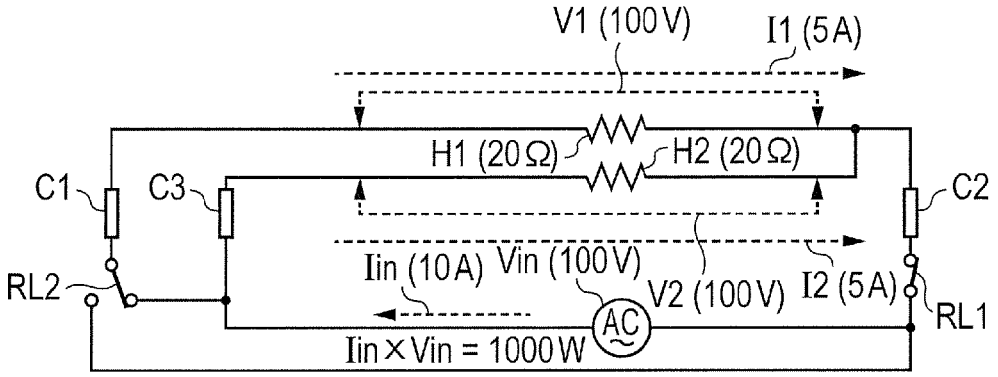
FIG. 4C is a view illustrating a parallel connection condition.

FIGS. 4A to 4C are schematic views for illustrating the heater 300, and the connection condition of the two heat generating members in accordance with the power supply voltage.

FIG. 4A shows a heat generation pattern (the heat generating members), a conductive pattern and electrodes formed on the heater substrate 105. Moreover, connecting portions to the connectors of FIG. 2 are shown to explain the connection to the power supply circuit 200 of FIG. 2. The heater 300 includes the heat generating members H1 and H2 formed by a resistance heat generation pattern. 303 is a conductive pattern. The power is supplied to the first heat generating member H1 of the heater 300 via an electrode E1 (the first electrode) and an electrode E2 (the second electrode), and the power is supplied to the second heat generating member H2 via the electrode E2 and an electrode (the third electrode) E3. The electrode E1 is connected to the connector C1, the electrode E2 is connected to the connector C2, and the electrode E3 is connected to the connector C3.

FIG. 4B is a view for illustrating the connection condition when the power supply voltage is 200 V, i.e., a first operation condition where the first heat generating member H1 and the second heat generating member H2 are connected in series. Here, for the explanation, the resistance value of each of the heat generating members H1 and H2 is 200Ω. In the first operation condition, resistors of 20Ω are connected in series, and hence a synthetic resistance value of the heater 300 is 40Ω. Since the power supply voltage is 200 V, the current supplied to the heater 300 is 5 A, and the power is 1000 W. A current I1 flowing through the first heat generating member and a current I2 flowing through the second heat generating member are 5 A, respectively. A voltage V1 applied to the first heat generating member and a voltage V2 applied to the second heat generating member are 100 V, respectively.

FIG. 4C is a view for illustrating the connection condition when the power supply voltage is 100 V, i.e., a second operation condition where the first heat generating member H1 and the second heat generating member H2 are connected in parallel. In the second operation condition, resistors of 20Ω are connected in parallel, and hence a synthetic resistance value of the heater 300 is 10Ω. Since the power supply voltage is 100 V, the current supplied to the heater 300 is 10 A, and the power is 1000 W. The current I1 flowing through the first heat generating member and the current I2 flowing through the second heat generating member are 5 A, respectively. The voltage V1 applied to the first heat generating member and the voltage V2 applied to the second heat generating member are 100 V, respectively.

There are compared the currents, voltages and power supplied to the heater in the states shown in FIGS. 4B and 4C. In the state of FIG. 4B, the current Iin is 5 A, and the power supplied to the heater is 1000 W, and in the state of FIG. 4C, the current Iin is 10 A, and the power supplied to the heater is 1000 W. Therefore, when the currents Iin are detected, the current values Iin are different from each other between the first operation condition and the second operation condition. On the other hand, in the state shown in FIG. 4B, the current I2 is 5 A, and the power supplied to the heater is 1000 W, and in the state shown in FIG. 4C, the current I2 is 5 A, and the power supplied to the heater is 1000 W. Thus, when the current I2 is detected and even when the operation condition of the heater 300 is switched from the first operation condition to the second operation condition, it is possible to detect the current value which is proportional to the power supplied to the heater 300.

Moreover, the voltage V2 applied to the heat generating member H2 is a product of the current I2 and the resistance value (20Ω), and hence in place of the current I2, the voltage V2 applied to the heat generating member H2 may be detected. When the voltage V2 is detected and the voltage value applied to the heat generating member H2 is 100 V in the state of FIG. 4B, the power supplied to the heater is 1000 W, and when the voltage value applied to the heat generating member H2 is 100 V in the state shown in FIG. 4C, the power supplied to the heater is 1000 W. Thus, when the voltage V2 is detected and even when the operation condition of the heater 300 is switched from the first operation condition to the second operation condition, it is possible to detect the voltage value which is proportional to the power supplied to the heater 300.

Moreover, in a normal condition shown in FIGS. 4B and 4C, also when the current I1 is detected, the current value is 5 A and the power supplied to the heater is 1000 W in the state shown in FIG. 4B, and the current value is 5 A and the power supplied to the heater is 1000 W also in the state shown in FIG. 4C. Furthermore, also in a case where the voltage V1 is detected, when the voltage value applied to the heat generating member H1 is 100 V in the state shown in FIG. 4B, the power supplied to the heater is 1000 W, and when the voltage value applied to the heat generating member H1 is 100 V in the state shown in FIG. 4C, the power supplied to the heater is 1000 W.

Thus, whether the first operation condition (the series connection condition) or the second operation condition (the parallel connection condition) exists, it is possible to detect the current or the voltage which is proportional to the power supplied to the heat generating member as a detection object, when the current (I1 or I2) flowing through one heat generating member or the voltage flowing through the one heat generating member (V1 or V2) is detected. Therefore, in a case where the power supplied to the heat generating member becomes abnormally large, an abnormal condition can be distinguished, when the current flowing through the one heat generating member or the voltage flowing through the one heat generating member is detected.

As described above, the current detection circuit 501 outputs the square value output Irms1 of the current effective value for each cycle of the commercial power supply frequency and the moving average deviations Irms2 of Irms1. The CPU 203 detects the current effective value for each commercial frequency cycle by Irms1. Even when the connection condition between the relay RL1 and the relay RL2 matches the power supply voltage, the CPU 203 performs power control (controls the drive of the triac TR1) so as to keep the power supplied to the heater at 1000 W or lower.

There will be a case where a current limit is disposed to set the power supplied to the heater to 1000 W or lower. For example, when the current I1 or I2 is detected, the power supplied to the heater can be limited to 1000 W or lower by disposing the current limit at 5 A irrespective of the operation condition of the heater 300 (i.e., whether the series connection condition or the parallel connection condition). Moreover, when the voltage V1 or V2 is detected, the power supplied to the heater can be limited to 1000 W or lower by disposing a voltage limit at 100 V irrespective of the operation condition of the heater 300 (i.e., whether the series connection condition or the parallel connection condition exists).

As an example of a method of controlling the power supplied to the heater so that the power is not higher than a predetermined power by use of the current detection result, a method described in Japanese Patent No. 3919670 can be used. The triac TR1 is controlled so that I2 is, for example, 5 A or lower at a usual time. When 6 A is set to the abnormal current, the control is performed so that the current I2 is 5 A or lower at usual control, and the power control is not possible owing to the failure of the triac TR1 or the like. When the abnormal current of 6 A or higher is detected, the operation can be performed so as to turn off the triac TR1 and the relays RL3 and RL4. Thus, when the currents I1 and I2 and the voltages V1 and V2 are detected, i.e., the connecting positions of the current detection section 205 and the voltage detection section 400 are contrived as in the present example, the power limiting (the current limiting) at a normal operation can be performed only by setting one abnormal current or one abnormal voltage, whether the series connection condition or the parallel connection condition exists.

Figure 5A:
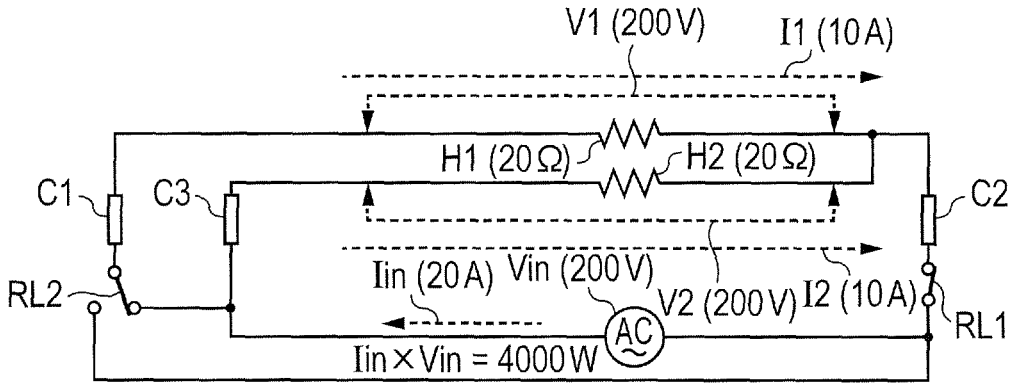
FIGS. 5A, 5B and 5C are views illustrating a failure condition of the circuit.
Figure 5B:
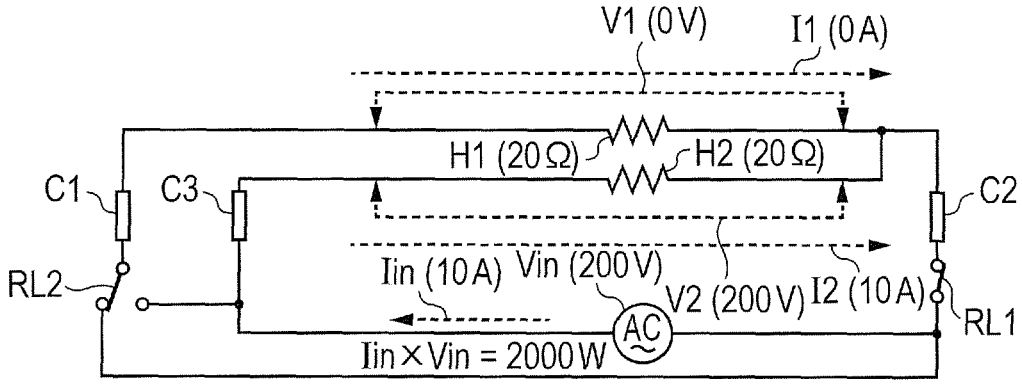
Figure 5C:
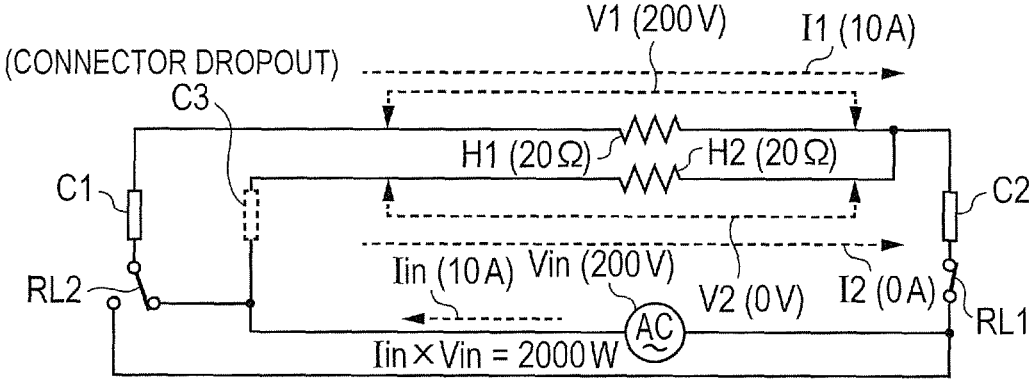

FIGS. 5A to 5C show a case where the power supply voltage detection unit 202 and the relays RL1 and RL2 as the connection condition switch section fail to operate properly, and the connection condition of the first heat generating member H1 and the second heat generating member H2 does not match the power supply voltage.

FIG. 5A is a view for illustrating a case where the operation condition is switched to the second operation condition (i.e., the parallel connection condition) where the heater resistance value is small, even when the voltage of the alternating current power supply 201 is 200 V. For example, when the alternating current power supply is 200 V, a state of 100 V is wrongly detected owing to the failure of the power supply voltage detection unit 202, and hence a failure condition occurs. In the second operation condition, the synthetic resistance value of the heater 300 is 10Ω. Since the power supply voltage is 200 V, the maximum current supplied to the heater 300 is 20 A, and the maximum power is 4000 W.

FIG. 5B is a view for illustrating a case where the power supply voltage is 200 V, the RL1 is turned on, and the RL2 is turned off. For example, the failure condition occurs when the RL1 causes a short failure. In this state, the current flows only through the heat generating member H2 (i.e., the only heat generating member H2 generates heat), and the synthetic resistance value of the heater 300 is 20Ω. Since the power supply voltage is 200 V, the maximum current supplied to the heater 300 is 10 A, and the maximum power is 2000 W.

FIG. 5C shows a case where the power supply voltage is 200 V, the RL1 is turned on, the RL2 is turned on, and further the connector C3 drops out. For example, this state is a failure condition which occurs further from the failure condition described with reference to FIG. 5A owing to double failure in which the connector C3 drops out. In this state, the current flows only through the heat generating member H1 (i.e., the only heat generating member H1 generates the heat), and the synthetic resistance value of the heater 300 is 20Ω. Since the power supply voltage is 200 V, the maximum current supplied to the heater 300 is 10 A, and the maximum power is 2000 W.

In the above three failure conditions, there is the possibility that a larger power is supplied to the heater 300 than at the normal time. In these failure conditions, the power supplied to the heater becomes excessively large, and hence in the safety circuit using a temperature detection element such as the thermistor 111 or the thermo SW 112, a response speed to interrupt the supply power to the heater does not become sufficient sometimes. It is considered that when the power interruption delays, the heater undergoes a thermal stress to break sometimes in an image heating apparatus using a ceramic heater.

To solve the problem, there are first compared the currents, voltages and power supplied to the heater in the failure conditions shown in FIGS. 5A and 5B. When the current Iin is detected, the current value of the current Iin is 20 A in the case of FIG. 5A, and is twice as large as the maximum value of 10 A of the current Iin at the normal time described with reference to FIGS. 4A to 4C (the case where the power supply voltage is 100 V as shown in FIG. 4C), so that the failure condition can be detected. However, in the case of FIG. 5B, the current value of the current Iin is 10 A, and the power supplied to the heater 300 is 2000 W. The current value is the same as the current Iin of FIG. 4C at the normal condition, and hence the failure condition cannot be detected only by the current detection result of the current Iin sometimes.

When the current I1 is detected, the current value of the current I1 is 10 A in the case of FIG. 5A, and is twice as large as a current value of 5 A at the normal time described with reference to FIGS. 4A and 4B, so that the failure condition can be detected. However, in the case of FIG. 5B, the current value of the current I1 is 0 A, and the power supplied to the heater 300 is 2000 W. In the state where the power is supplied to the heater 300, the current I1 does not flow, and hence the failure condition of FIG. 5B cannot be detected only by the current detection result of the current I1 sometimes. On the other hand, when the current I2 is detected, in both the cases of FIGS. 5A and 5B, it is possible to detect the current value of 10 A which is twice as large as that at the normal time described with reference to FIGS. 4A to 4C, irrespective of the failure conditions of the relays RL1 and RL2. Therefore, the failure conditions of FIGS. 5A and 5B can be detected.

When the voltage V2 is detected, it is possible to detect a voltage value of 200 V (the overvoltage) which is twice as large as the value at the normal time described with reference to FIGS. 4A to 4B, irrespective of the failure condition of the relays RL1 and RL2. Therefore, the failure conditions of FIGS. 5A and 5B can be detected.

Thus, when the current I2 flowing through the second heat generating member H2 between the electrode E2 and the electrode E3, the voltage V2 applied to the second heat generating member H2 or the voltage V1 applied to the first heat generating member H1 are detected, the failure conditions shown in FIGS. 5A and 5B can be detected, respectively. Additionally, the heat generating member H2, which is the detection object of the current detection section 205, or the voltage detection section 400 is the heat generating member on a connected side to the alternating current power supply 201 not via the relay RL2 including the transfer contact.

As discussed above, the current detection section (the second and third circuits) 205 is disposed in the power supply path after branching toward the first heat generating member H1 and the second heat generating member H2 in the parallel connection condition. In particular, when the two heat generating members are switched to the series connection condition or the parallel connection condition by a combination of the relay RL1 including the make contact or the break contact and the relay RL2 including the transfer contact, the current detection section 205 is preferably disposed in the power supply path of the heat generating member H2 on the connected side to the alternating current power supply 201 not via the relay RL2 including the transfer contact.

Moreover, the second voltage detection section (the first circuit) 400 is disposed to detect the voltages applied to both the ends of the first heat generating member H1 and the voltages applied to both the ends of the second heat generating member H2 in the series connection condition. In particular, when the two heat generating members are switched to the series connection condition or the parallel connection condition by the combination of the relay RL1 including the make contact or the break contact and the relay RL2 including the transfer contact, the voltage detection section 400 is preferably disposed so that it is possible to detect the voltages applied to both the ends of the heat generating member H2 on the connected side to the alternating current power supply 201 not via the relay RL2 including the transfer contact.

Next, the failure condition shown in FIG. 5C will be described. FIG. 5C shows a state where the connector C3 further drops out from the failure condition of FIG. 5A. Even in this double failure condition, when the failure condition can be detected, reliability of the apparatus can further be enhanced.

There will be described the current, voltage and power supplied to the heater in the failure condition shown in FIG. 5C. When the current I2 is detected, in the case of FIG. 5C, the current value of the current I2 is 0 A, and the power supplied to the heater 300 is 2000 W. In this double failure condition, the failure condition cannot be detected by the current I2.

In contrast, the applied voltage detection section 400 can detect the voltages applied to the first heat generating member H1 and both the ends of the second heat generating member H2 in the parallel connection condition. Therefore, the voltage V1 can be detected in the state of FIG. 5C. When the voltage V1 is detected, it is possible to detect the voltage value of 200 V which is twice as large as the value at the normal time described with reference to FIGS. 4A to 4C. Therefore, the failure condition of FIG. 5C can be detected.

Additionally, in the power supply circuit 200, an upper limit value of the current supplied to the heater 300 is set to perform the control based on the Irms1 signal of the current detection circuit 501 (e.g., the control is performed so that the consumption current of the whole apparatus is 15 A or lower which is the upper limit current according to the law of protection against electrical hazard). The output of the current detection section 205 is used in the safety circuit and also used in the current control of the heater 300. When another failure detecting means is disposed in addition to the current detection section 205 used besides failure detecting means, the voltage detection section 400 is used as described with reference to FIGS. 5A to 5C, so that the double failure condition of FIG. 5C can be detected. Therefore, the reliability of the apparatus can further be enhanced.

There will be described the operation condition of the triac TR1, and the power supplied to the heater and the detection results by the voltage detection section (the first circuit) 400, the current detection circuit (the second circuit) 501 and the current detection circuit (the third circuit) 502 in each failure condition with reference to FIG. 6.

A waveform 1 shown in FIG. 6 is a current waveform when the triac TR1 is constantly turned on. As to the state of the waveform 1, the current value and the voltage value have been described with reference to FIGS. 5A to 5C. There is assumed, by the waveform 1, a case where the triac TR1 causes the short failure. The right side of the waveform indicates the power supplied to the heater, the voltage effective value which can be detected by the voltage detection section 400, and the current effective value which can be detected by the current detection circuits 501 and 502 in each failure condition. The description of ○ and × indicates whether or not each detection circuit can detect the failure condition (○ indicates that the failure condition can be detected, and × indicates that the failure condition cannot be detected).

A waveform 2 of FIG. 6 indicates a state where the power of the waveform 1 is controlled to be about 66% by the triac TR1. The power supplied to the heater 300 is 2640 W in the failure condition shown in FIG. 5A, and 1320 W in the states shown in FIGS. 5B and 5C. The description of the failure detection of the waveform 1 of FIG. 6 coincides with the description of FIGS. 5A to 5C, and hence the description thereof is omitted. The failure detection of the waveform 2 of FIG. 6 will be described. As to the voltages applied to both the ends of each of the first heat generating member H1 and the second heat generating member H2, the voltage detection section 400 can similarly detect the voltage applied only to the heat generating member H1, the voltage applied only to the heat generating member H2, and the voltages applied to the heat generating members H1 and H2 connected in parallel. Therefore, when the voltage is applied to one of the heat generating members H1 and H2 as in the states shown in FIGS. 5B and 5C (the power supplied to the heater is 1320 W), a high voltage value of 162.5 V can be detected in the same manner as in the failure condition of FIG. 5A (the case where the power supplied to the heater is 2640 W).

A waveform 3 of FIG. 6 shows a case where the negative half wave of the triac TR1 further causes an open failure in the state of the waveform 2. Therefore, the power is not supplied to the negative half wave. The power supplied to the heater 300 is 1320 W in the failure condition of FIG. 5A, and 660 W in the states shown in FIGS. 5B and 5C.

Figure 10A:
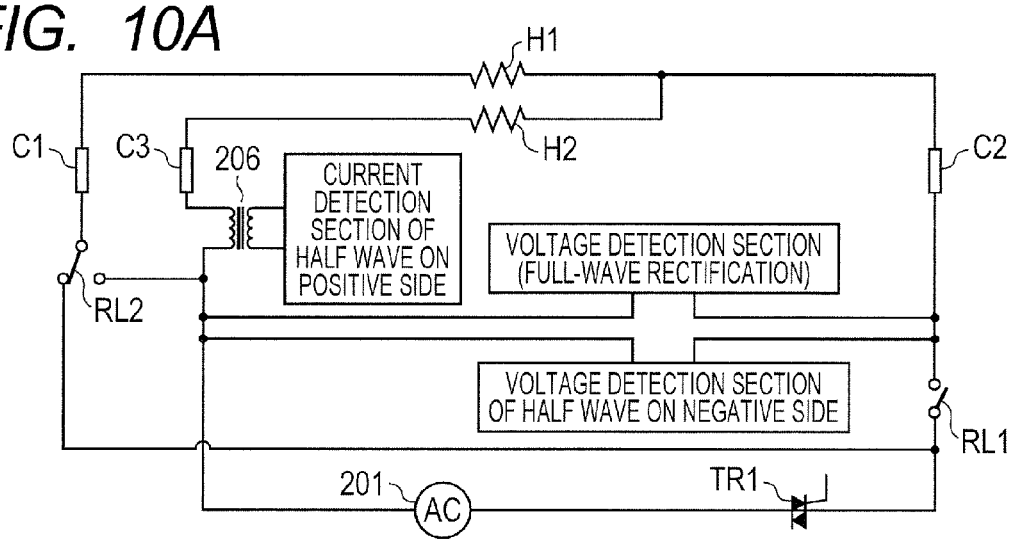
FIGS. 10A, 10B and 10C are views showing modifications of the power supply circuit of FIG. 2.
Figure 10B:
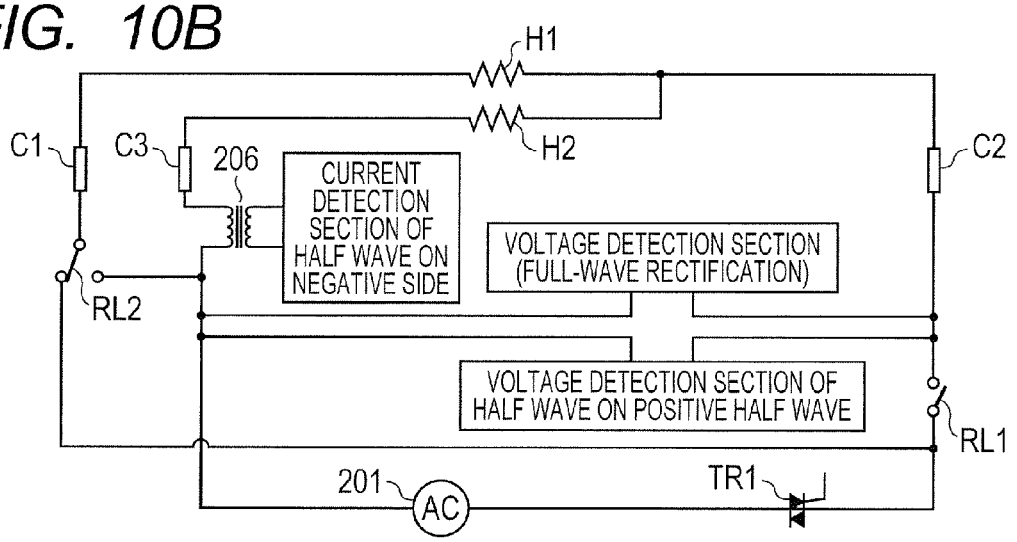
Figure 10C:
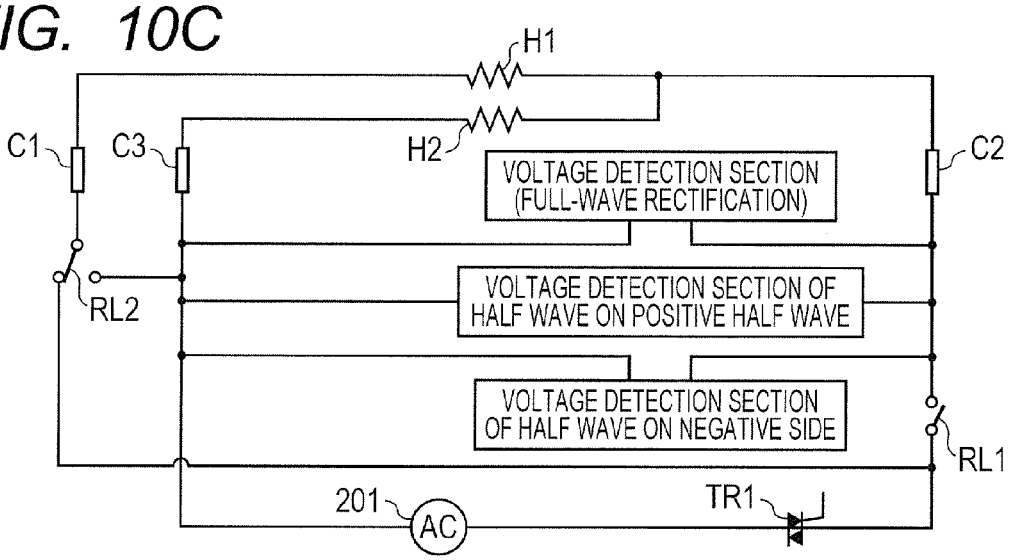

A waveform 4 of FIG. 6 shows a case where the positive half wave of the triac TR1 further causes the open failure in the state of the waveform 2. Therefore, the power is not supplied to the positive half wave. The power supplied to the heater 300 is 1320 W in the failure condition of FIG. 5A, and 660 W in the states of FIGS. 5B and 5C. The failure detection of the waveforms 3 and 4 described with reference to FIG. 6 will be described. Since the current detection section 501 detects the only positive half wave, the same high current value of 8.1 A as that of the waveform 2 (the case where the power supplied to the heater is 2640 W) can be detected also in the state of the waveform 3 (the power supplied to the heater is 1320 W). Moreover, since the current detection section 502 detects the only negative half wave, the same high current value of 8.1 A as that of the waveform 2 (the case where the power supplied to the heater is 2640 W) can be detected also in the state of the waveform 4 (the power supplied to the heater is 1320 W). Thus, when the power is supplied only to the positive half wave or the negative half wave, a method of detecting the positive and negative half wave currents by the current detection sections 501 and 502, respectively, to detect the failure condition is effective. Here, there is also considered a method of detecting the positive half wave voltage in place of the current detection section 501 or a method of detecting the negative half wave voltage in place of the current detection section 502 (see FIGS. 10A to 10C). In the example shown in FIG. 2, the current detection section 205 has a function of controlling the currents supplied to the heat generating members H1 and H2, and hence the currents of the positive and negative half waves are detected, respectively. However, also in the examples shown in FIGS. 10A to 10C, the latch control section (the safety circuit) 204 can be operated in accordance with various failure conditions. That is, there may be provided a first circuit disposed so that voltages applied to both ends of the first heat generating member and voltages applied to both ends of the second heat generating member are detectable, to detect the voltages of a positive phase and a negative phase of an alternating current waveform; a second circuit "disposed in the power supply path on the second heat generating member side after branching toward the first heat generating member and the second heat generating member in the parallel connection condition, to detect a current of the positive phase of the alternating current waveform" or "disposed so that the voltages applied to both the ends of the first heat generating member and the voltages applied to both the ends of the second heat generating member are detectable, to detect the voltage of the positive phase of the alternating current waveform"; and a third circuit "disposed in the power supply path on the second heat generating member side after branching toward the first heat generating member and the second heat generating member in the parallel connection condition, to detect a current of the negative phase of the alternating current waveform" or "disposed so that the voltages applied to both the ends of the first heat generating member and the voltages applied to both the ends of the second heat generating member are detectable, to detect the voltage of the negative phase of the alternating current waveform". Moreover, in a case where the output of at least one of the first to third circuits is in excess of a predetermined value, the safety circuit 204 may drive the switch section so as to interrupt the power supply to the first and second heat generating members. As described above, in the state shown in FIG. 5C, the failure conditions of the waveforms 3 and 4 described with reference to FIG. 6 cannot be detected by the current detection section 205 (the current detection sections 501 and 502). However, when the power of the positive or negative half wave is only supplied as in the waveforms 3 and 4 in the failure condition shown in FIG. 5C, the power supplied to the heater 300 is 660 W, and is not higher than the power at the normal time described with reference to FIGS. 4A to 4C. Therefore, this failure condition can be protected by the safety circuit through the heater temperature detection (the safety element 112 and the temperature detection element 111). Moreover, when the failure of the waveforms 3 and 4 described with reference to FIG. 6 is detected by the voltage detection section 400, in consideration of the voltage range of the 100 V series (e.g., 100 V to 127 V), the detection result of 114.9 V which is lower than 127 V in the voltage range of the 100 V series cannot be determined to be the failure. In a waveform 5 shown in FIG. 6, the power of the positive half wave of the waveform 1 is about 33% by the triac TR1 and the negative half wave is constantly turned on. The power supplied to the heater 300 is 2640 W in the failure condition of FIG. 5A, and 1320 W in the states shown in FIGS. 5B and 5C. The failure detection of the waveform 5 will be described. The power of the same level as in a usual state (the abnormal condition cannot be detected) is also supplied to the positive half wave of the waveform 5, and all the negative half waves are turned on. To detect the state of the waveform 5 in the state shown in FIG. 5C, the voltage detection section 400 preferably detects the waveform subjected to the full-wave rectification. For example, when the voltage detection section 400 detects the only positive half wave, the positive half wave voltage of the waveform 5 is 114.9 V which is lower than 127 V in the voltage range of 100 V series, so that the failure condition cannot be determined. Thus, when the waveform 5 is taken into consideration, the voltage subjected to the full-wave rectification is preferably detected. In this way, a method is effective in which means for detecting the voltage subjected to the full-wave rectification, means for detecting the positive current (voltage) and means for detecting the negative current (voltage) are combined and used as the means for detecting the heater current waveforms 1 to 5 shown in FIG. 6 and the failure conditions shown in FIGS. 5A to 5C.

Figure 7:
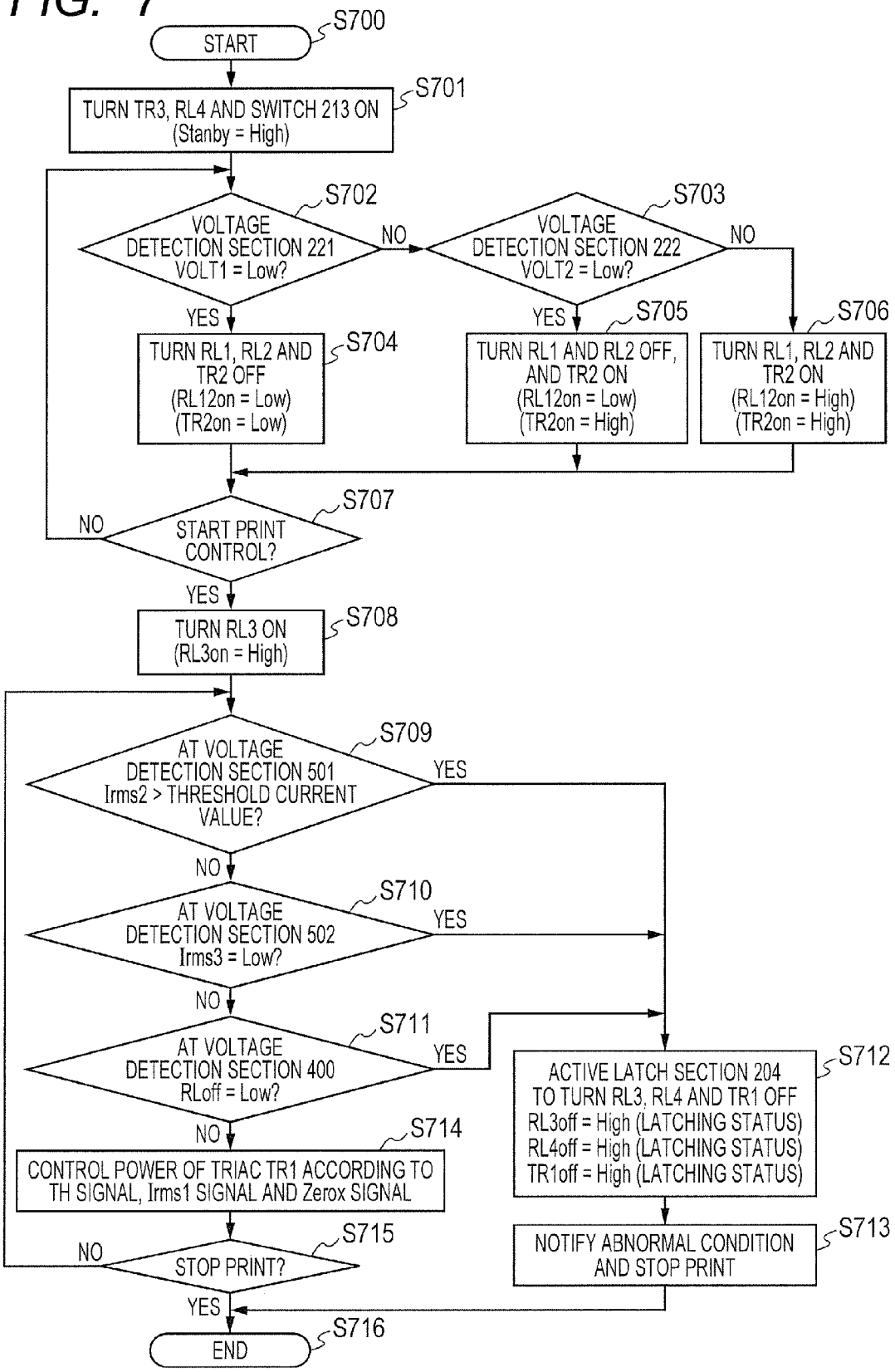
FIG. 7 is a flowchart for illustrating an operation sequence of an apparatus including a failure detection sequence.

FIG. 7 is a flowchart for illustrating an operation sequence of the apparatus including a failure detection sequence by the CPU 203.

In S700, on receiving a request for the standby state of the power supply circuit 200, the control is started to advance to S701. In the S701, the standby signal becomes high, and the triac TR3, the relay RL4 and the switch 213 are turned on. The converter 211 operates, so that the voltage detection unit 202 and the zero cross detection section 214 can detect the voltage and zero cross of the alternating current power supply 201. In this initial state, the converter 211 has the full-wave rectification condition, and the heater 300 has the series connection condition.

In S702, the range of the power supply voltage is determined based on the VOLT1 signal which is the output of the voltage detection section 221. When the power supply voltage is 200 V series, the method advances to S704, and when the voltage is 100 V series, the method advances to S703.

In S703, the range of the power supply voltage is determined based on the VOLT2 signal which is the output of the voltage detection section 222. When the power supply voltage is 200 V series, the method advances to S705, and when the voltage is 100 V series, the method advances to S706.

In the S704, the RL12*on* signal is set to the low state, and the relays RL1 and RL2 are turned off, to set the heater 300 to the series connection condition. The TR2*on* signal is set to the low state, and the triac TR2 is turned off, to set the converter 211 to the full-wave rectification condition.

In the S705, the RL12*on* signal is set to the low state, and the relays RL1 and RL2 are turned off, to set the heater 300 to the series connection condition. The TR2*on* signal is set to the high state, and the triac TR2 is turned on, to set the converter 211 to the voltage doubler rectification condition.

In the S706, the RL12*on* signal is set to the high state, and the relays RL1 and RL2 are turned on, to set the heater 300 to the parallel connection condition. The TR2*on* signal is set to the high state, and the triac TR2 is turned on, to set the converter 211 to the voltage doubler rectification condition.

Figure 9:
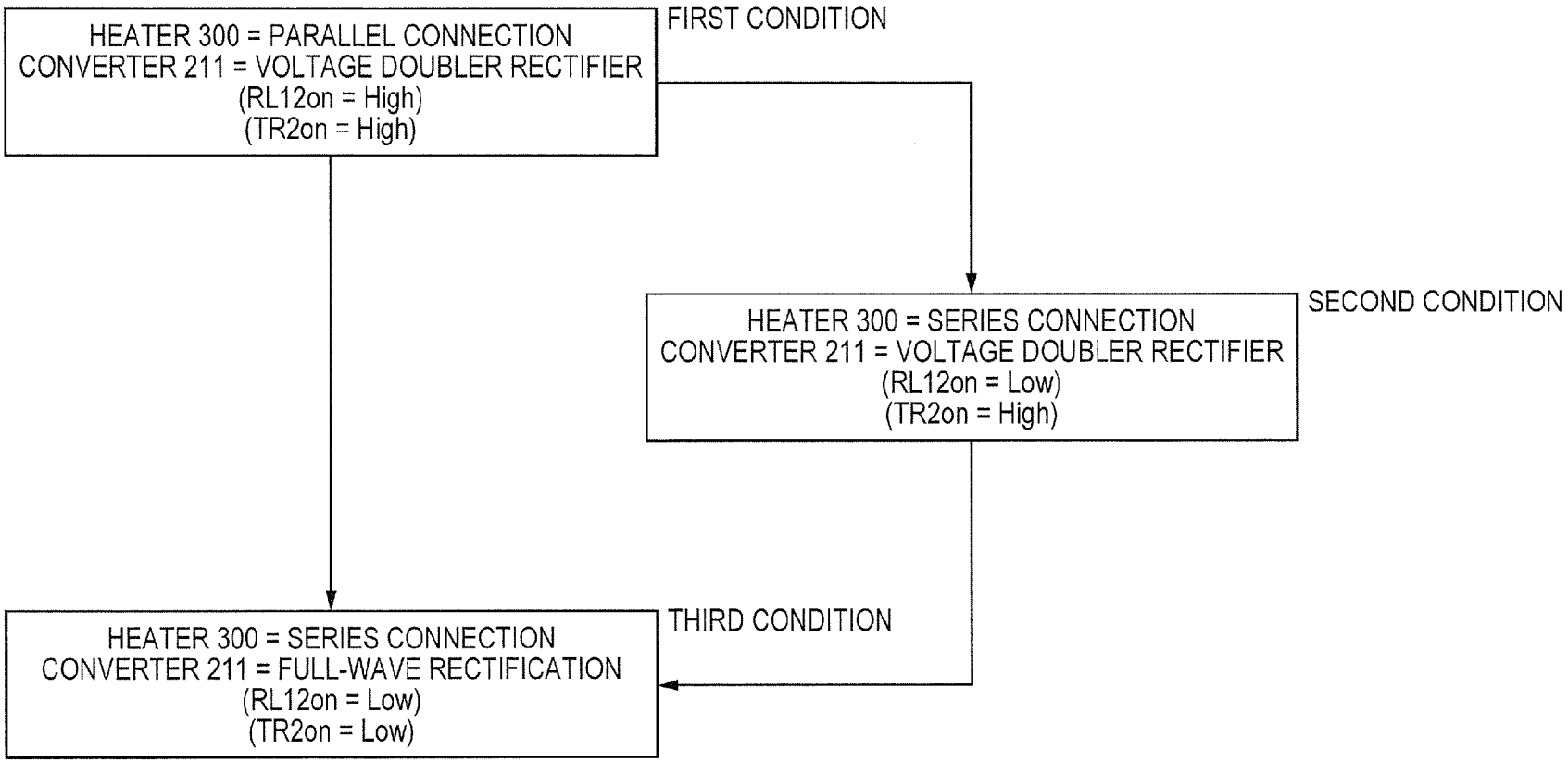
FIG. 9 is a condition transition diagram of a power supply circuit 200.

When the condition of the control circuit 200 is determined in the S702 to the S706, as shown in FIG. 9, a limit may be put on the condition transition of the power supply circuit 200. The condition transition diagram of the power supply circuit 200 shown in FIG. 9 will be described. FIG. 9 shows the transition among three conditions of a first condition of the power supply circuit 200 (as described in the S706, the heater 300 is connected in parallel and the converter 211 is a voltage doubler rectifier); a second condition (as described in the S705, the heater 300 is connected in series and the converter 211 is the voltage doubler rectifier); and a third condition (as described in the S704, the heater 300 is connected in series and the converter 211 is a full-wave rectifier). The condition of the power supply circuit 200 is stored in the CPU 203. As shown in FIG. 9, control is performed so that the power supply circuit 200 can transit from the first condition to the second condition and the third condition, and the power supply circuit 200 can transit from the second condition to the third condition and cannot transit from the third condition to any condition. Additionally, the condition stored in the CPU 203 is reset when starting the control in the S700.

A reason why the limit is put on the condition transition in this manner is that when the image forming apparatus is used in, for example, a location in which the commercial power supply is 200 V, there are prevented situations where owing to power stoppage or voltage fluctuation, the voltage of the commercial power supply primarily decreases, the state of 100 V is detected, the heater 300 switches from the series connection condition to the parallel connection condition and the converter 211 switches from the full-wave rectification condition to the voltage doubler rectification condition. When the limit is put on the condition transition of the power supply circuit 200 in this manner, the safety of the apparatus can be enhanced in a case where the voltage of the commercial power supply primarily decreases.

The above processing is repeatedly performed until a determination to start the print control is made in S707. When the print control is started, the method advances to S708.

In the S708, the RL3*on* signal is set to the high state and the RL3 is turned on. In S709, when the voltage based on the output Irms2 of the current detection section 501 is not lower than a predetermined threshold voltage value, i.e., when the overcurrent is detected, the step advances to S712.

In S710, when the current detection section 502 detects the current higher than the predetermined current, i.e., the overcurrent, the Irms3 signal becomes low, and the method advances to the S712.

In S711, when the voltage detection section 400 detects the voltage higher than the predetermined voltage, i.e., the overvoltage, the RLoff signal becomes low, and the method advances to the S712.

In the S712, the latch control section 204 activates the TR1, RL3 and RL4 latch sections, sets the TR1*off* signal, the RL3*off* signal and the RL4*off* signal to the high state, and holds the TR1, RL3 and RL4 in the off state (the latching status). In S713, the abnormal condition is notified, a print operation is urgently stopped, and the method advances to S716, thereby ending the control.

When any abnormality is not detected in the S709 to the S711, the method advances to S714. In the S714, the CPU 203 controls the triac TR1 by use of the PI control based on the TH signal output by the temperature detection element 111, the Irms1 signal output by the current detection section 501, and the Zerox signal of the zero cross detection section 214, to control the power supplied to the heater 300 (the phase control, the wave number control, or the combined control of the phase control and the wave number control). In S715, the processing of the S709 to the S714 is repeated until the print end is determined in the S715. When the printing ends, the method advances to the S716, to end the control.

INDUSTRIAL APPLICABILITY

In an image forming apparatus in which two heat generating members are switched to a series connection condition or a parallel connection condition, a current detection section 205 and a voltage detection section 400 are arranged, and arrangement positions of the sections and a rectification method are contrived, so that failure of the apparatus can be detected and reliability of the apparatus can be enhanced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2011-201835, filed Sep. 15, 2011, and No. 2012-196240, filed Sep. 6, 2012 which are hereby incorporated by reference herein in their entirety.

The invention claimed is:

1. An image forming apparatus comprising:

a fixing section which heat-fixes an image formed on a recording material to the recording material, the fixing section including a first heat generating member and a second heat generating member which generate heat by a power supplied from a power supply through a power supply path; and a connection condition switch section which switches the first heat generating member and the second heat generating member between a series connection condition and a parallel connection condition, wherein said image forming apparatus further comprises:

a first circuit disposed so that voltages applied to both ends of the first heat generating member and voltages applied to both ends of the second heat generating member are detectable, to detect the voltages of a positive phase and a negative phase of an alternating current waveform;

a second circuit that detects a current of only the positive phase of the alternating current waveform, the second circuit being disposed in the power supply path on the second heat generating member side after branching toward the first heat generating member and the second heat generating member in the parallel connection condition, or at a position in which the voltages applied to both the ends of the first heat generating member and the voltages applied to both the ends of the second heat generating member are detectable, to detect the voltage of only the positive phase of the alternating current waveform; and a third circuit that detects a current of only the negative phase of the alternating current waveform, the third circuit being disposed in the power supply path on the second heat generating member side after branching toward the first heat generating member and the second heat generating member in the parallel connection condition, or at a position in which the voltages applied to both the ends of the first heat generating member and the voltages applied to both the ends of the second heat generating member are detectable, to detect the voltage of only the negative phase of the alternating current waveform.

2. An image forming apparatus according to claim 1, further comprising:

a switch section disposed in the power supply path to the first and second heat generating members; and a safety circuit which drives the switch section in accordance with outputs from the first to third circuits, wherein in a case where the output of at least one of the first to third circuits is in excess of a predetermined value, the safety circuit drives the switch section so as to interrupt the power supply to the first and second heat generating members.

3. An image forming apparatus according to claim 2, wherein the switch section is a relay.

4. An image forming apparatus according to claim 2, wherein the switch section is a triac.

5. An image forming apparatus according to claim 1, wherein the connection condition switch section includes a relay including a make contact or a break contact, and a relay including a transfer contact, and wherein the second heat generating member is connected to the power supply not via the relay including the transfer contact.

6. An image forming apparatus according to claim 1, wherein the first circuit detects the voltage obtained by full-wave rectification of the alternating current waveform.

7. An image forming apparatus according to claim 1, further comprising a heat sensitive element which detects temperature rises of the first and second heat generating members to interrupt the power supply path.

8. An image forming apparatus according to claim 1, wherein said image forming apparatus further comprises:

a temperature detection element which detects the temperature of the fixing section; and a control section which controls the power to be supplied to the first and second heat generating members in accordance with the detected temperature of the temperature detection element.

9. An image forming apparatus according to claim 8, wherein the second circuit is a current detection circuit, and the control section limits the power to be supplied to the first and second heat generating members in accordance with an output from the current detection circuit.

10. An image forming apparatus according to claim 9, wherein the output from the current detection circuit which is used to limit the power to be supplied to the first and second heat generating members is a square value of a current effective value.

11. An image forming apparatus according to claim 2, wherein the second circuit is a current detection circuit, and an output from the current detection circuit which is used to drive the switch section is a moving average deviation of the square value of the current effective value.

12. An image forming apparatus according to claim 1, wherein said image forming apparatus further comprising:

a power supply voltage detection section which detects the voltage of the power supply, and a control section which controls the connection condition switch section in accordance with the detected voltage of the power supply voltage detection section.

13. An image forming apparatus according to claim 1, wherein the fixing section includes an endless belt, a heater which includes the first and second heat generating members and comes in contact with the inner surface of the endless belt, and a nip portion forming member which forms a nip portion to perform fixing processing of the recording material, together with the heater via the endless belt.

* * * * *